United States Patent [19]

Schwartz

[11] 3,972,082

[45] Aug. 3, 1976

[54] FLOATING COLLAR FOR BOATS

[76] Inventor: Robert C. Schwartz, 17621 Irvine Blvd., Suite 101, Tustin, Calif. 92680

[22] Filed: May 6, 1975

[21] Appl. No.: 574,951

[52] U.S. Cl. ..... 9/14; 9/3

[51] Int. Cl.[2] ..... B63C 9/00

[58] Field of Search ..... 9/3, 4, 14, 1 D, 311; 114/123, 219, 220; 267/69–72; 248/54 R, 74 R

[56] References Cited

UNITED STATES PATENTS

| | | | |
|---|---|---|---|
| 1,110,798 | 9/1914 | Kralik | 114/219 |
| 1,509,551 | 9/1924 | Gibson | 9/311 |
| 2,341,010 | 2/1944 | Baier | 9/3 |
| 3,848,839 | 11/1974 | Tillman | 248/54 R |

*Primary Examiner*—Trygve M. Blix
*Assistant Examiner*—Sherman D. Basinger

[57] ABSTRACT

A buoyant collar is stored in a biased condition around the top outside of a boat hull. Should the boat overturn the buoyancy of the collar will work against the biasing and allow the collar, still attached to the boat, to float to the surface and provide a hand hold for the persons in the water.

2 Claims, 6 Drawing Figures

FLOATING COLLAR FOR BOATS

BACKGROUND OF THE INVENTION

1. Field of the Invention

This invention is directed generally to nautical life saving devices and more particularly to a buoyant collar carried in a stored position around the top of a boat hull which will self actuate, if the boat should overturn, and float to the surface to provide hand holds for persons in the water.

Along with the great gain in popularity and numbers of boats, there has also been a proportionate rise in the number of boating accidents. Also the most numerous boats in use are the type taking an outboard motor and the small sail boat. These boats normally carry more than one person and neither is too difficult to overturn.

When this happens, leaving the boat bottom side up, there is no place to hold on the smooth bottom. Whatever debris floats up will be available as a flotation device for the swimmers but unless they lash themselves together their chances of drifting apart are very great.

Drifting from the scene of the accident is one of the biggest problems encountered in the rescue of a person in the water. It is especially difficult in the open water where a small chop may raise white caps. Where more than one person is involved the problem is compounded if they drift apart.

2. Description of the Prior Art

U.S. Pat. 1,470,983 to Jayne shows a skeletal frame fitted over a boat and pivoted, float supported rings attached thereto to provide hand holds should the boat overturn. These rings are not adjustable up and down the frame and are dependent for utility on the depth to which the boat sinks. It is entirely possible for the capsized boat to be submerged to a depth where the rings are held below the surface and cannot be held on to.

SUMMARY OF THE INVENTION

It is therefor the primary object of this invention to provide a nautical safety device comprising a buoyant collar stored in a biased condition on the top outside of a boat hull which, if the boat should overturn, will self actuate and float to the surface while still attached to the boat and provide a hand hold for persons in the water.

It is also an object of this invention to provide a buoyant collar stored in a position on the top outside of a boat hull which will act as a bumper for the boat.

It is another object of this invention to provide a buoyant collar for a boat which may be made from various buoyant materials such as plastic, cork, wood or is an inflatable tube.

These and other features and advantages of the present invention will become more apparent from the following detailed description and drawings forming a part thereof in which.

DESCRIPTION OF THE PREFERRED EMBODIMENT

Figure 1:
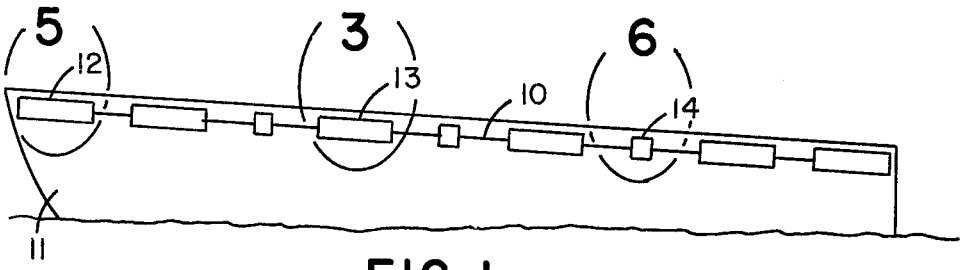
FIG. 1 is a view of the device on a boat in normal use

A nautical safety device 10 carried in a stored condition on the top outside of a boat hull 11 comprises a plurality of tension assemblies 12 attached to the boat hull by suitable means, a buoyant collar assembly 13 attached in biased suspension between two tension assemblies 12 and a plurality of fairlead assemblies 14 attached to the boat hull by suitable means engaging the collar assembly to assist in holding it in its stored position.

The tension assemblies 12 each comprise a substantially U-shaped spring housing 15 having a bottom 16 a first leg 17 and a second leg 18. Each leg 17 and 18 has an aperture therethru substantially in line with each other with the aperture 19 in the first leg 17 being larger in diameter than the aperture 20 in the second leg 18. The first leg 17 has a second opening 21 extending therethru. To attach the spring housing 15 to the boat hull 11 the bottom 16 has a plurality of apertures 22 therein with matching apertures 22 in the boat hull 11 and a flat back up plate 23 placed inside the hull 11 to avoid damage during the torquing of the attach bolts 24 and nuts 25.

A spring follower 26 having a flat main body 27 a first end configured in a hook 28 and a second end 29 bent substantially ninety degrees to the main body 27. The second end 29 has an aperture 30 therethru of the same diameter as the aperture 19 in the first end 17 of the spring housing 15.

The spring follower 26 is placed inside the spring housing 15 with its hooked first end 28 extending thru the opening 21 of the first leg 17 and an elongate compression spring 31 is entrapped in the spring housing 15 between the first leg 17 and the second end 29 of the spring follower 26. A shoulder bolt 32 enters into the aperture 19 in the first leg 17, slides thru the inside of the spring 31 passing thru the aperture 30 in the second end 29 of the spring follower 26 but the shoulder portion 33 is stopped by the smaller diameter of the aperture 20 in the second leg 18 of the spring housing 15 which will only pass the threads 34. A nut 35 locks the bolt 32 in this position.

A cover 36 having a bottom 37 two sides 38 and two open centered ends 39 fits in frictional engagement over the legs 17 and 18 of the spring housing 15.

Figure 4:
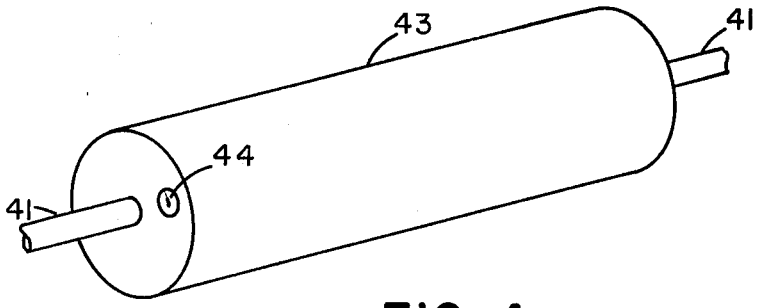
FIG. 4 is a perspective view of an inflatable tube as the buoyant float taken at position 3 in FIG. 1
Figure 5:
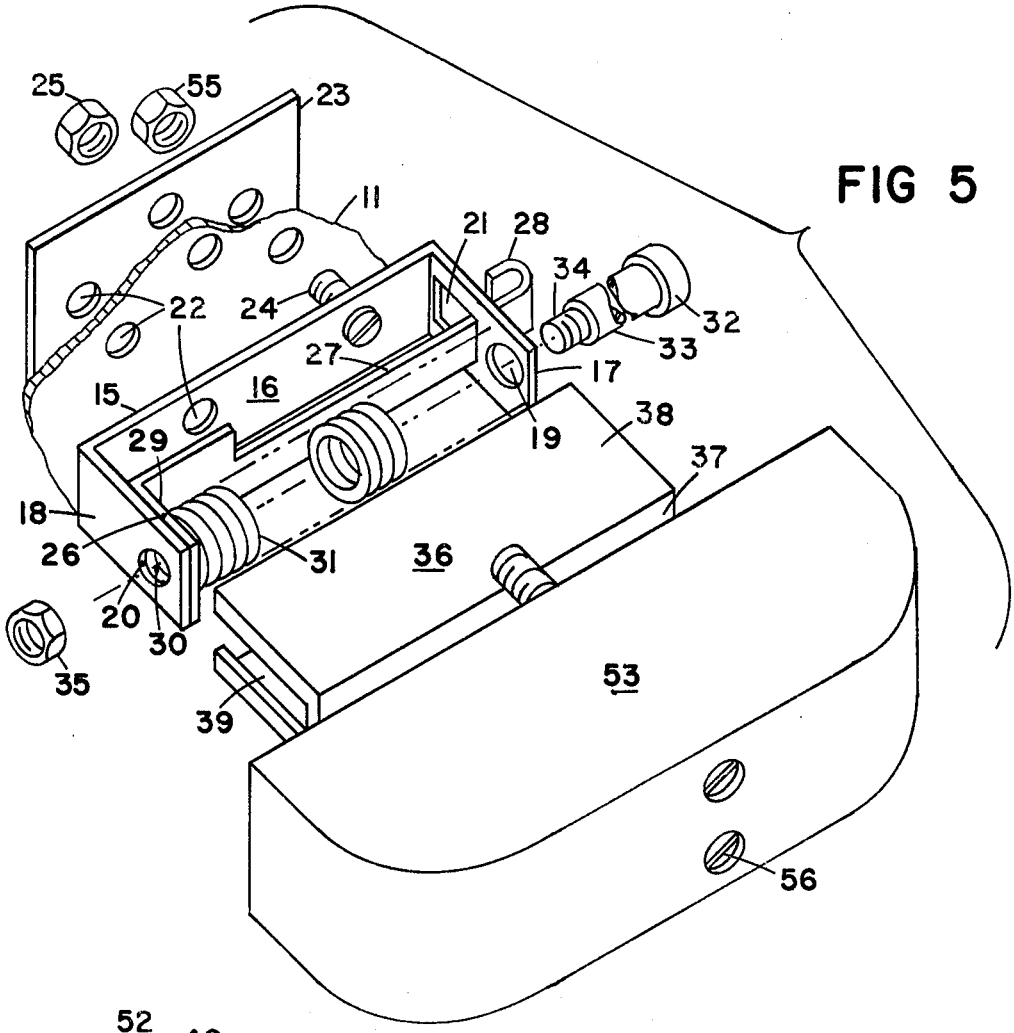
FIG. 5 is an exploded view of the tension assembly and bumper taken at position 5 in FIG. 1
Figure 6:
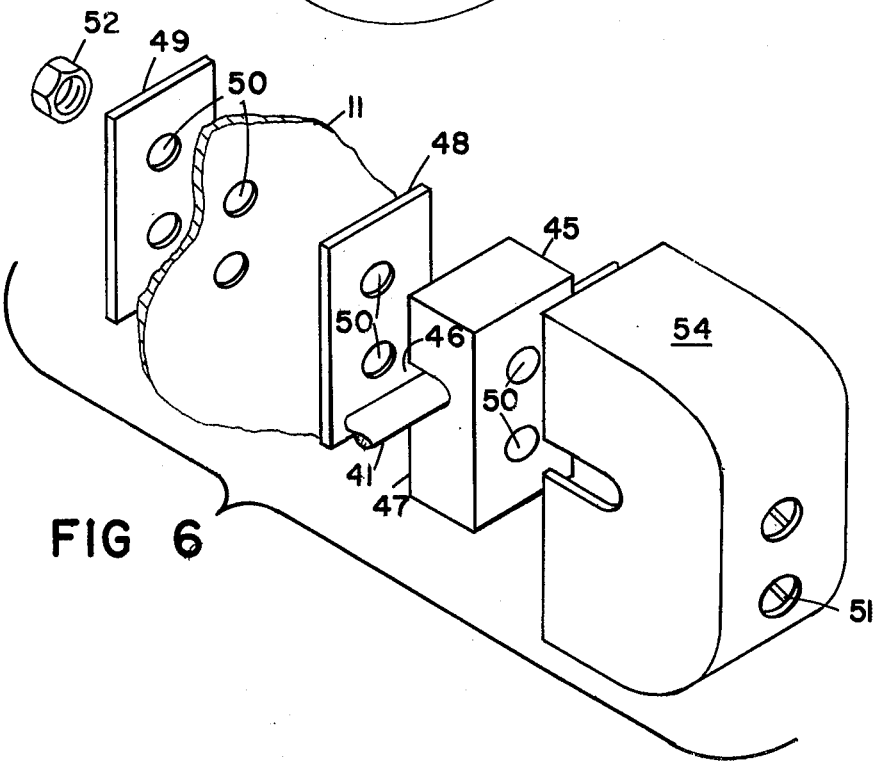
FIG. 6 is an exploded view of the fairlead assembly and bumper taken at position 6 in FIG. 1

The buoyant collar assembly 10 comprises a plurality of floats 40 made of a suitable buoyant material, attached in substantially equidistant relationship on a flexible cable 41. As shown in FIG. 4 the float 40 may be an inflatabel tube 43 having valve 44 therein for introducing the inflating medium. The ends of the cable 41 are formed by suitable means into an eye loop 42 which engages in the hooked end 28 of the spring follower 26 of the tension assembly 12. In this position the collar assembly is held suspended at the top outside of the boat hull 11 by the biasing action of the compression spring 31 against the spring follower 26.

The fairlead assemblies 14 each comprise a rectangular block 45 having a semi-circular recess 46 extending inwardly from one side 47, a flat closure plate 48 and a flat back up plate 49 each have a matching plurality of apertures 50 therethru for attaching the assembly 14 to the boat hull 11 by suitable means such as bolts 51 and nuts 52.

In operation the flexible cable 41 is placed in the recess 46 and the block 45 and closure plate 48 are assembled to the hull 11 and the back up plate 49. The cable 41 will slide easily thru the recess 46 but the fairlead assembly assists in holding the buoyant collar assembly 13 in biased suspension at the top outside of the boat hull 11.

Semi-rigid bumpers 53 and 54 made of suitable material such as high density foam are removably attached to the boat hull 11 bu suitable means such as nuts 52 and 55 and bolts 51 and 56 to enclose each tension assembly 12 and each fairlead assembly 14 and serve as fenders for the boat hull 11.

Figure 2:
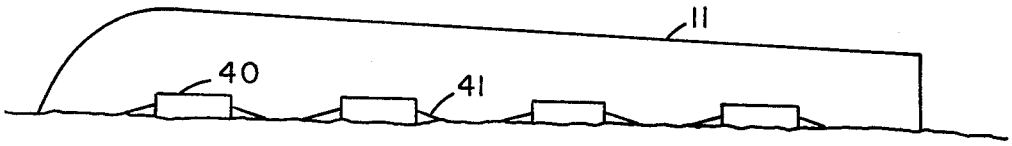
FIG. 2 is a view of a capsized boat showing the safety device actuated
Figure 3:
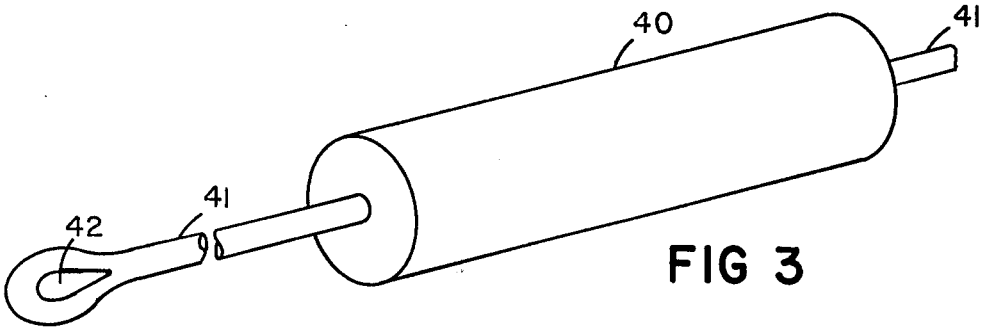
FIG. 3 is a perspective view of the buoyant collar assembly taken at position 3 in FIG. 1

In normal boating use, as shown in FIG. 1 the safety device 10 is carried stored in biased suspension at the top outside of the boat hull 11. Should the boat overturn, as shown in FIG. 2, the buoyancy of the floats will self actuate to work against the biasing action of the compression spring 31 and float to the surface to provide a boat attached hand hold for persons in the water.

I claim:

1. A nautical safety device carried on the top outside of a boat hull comprises:

a plurality of tension assemblies attached by suitable means to said boat hull;

wherein said tension assemblies each comprise:

a substantially U-shaped spring housing having a bottom, a first leg, and a second leg, each said leg having an aperture therethru substantially in line with each other, said aperture in said first leg being larger than said aperture in said second leg, said first leg having a second opening extending therethru;

a flat backup plate;

a spring follower enclosed in said spring housing having a flat main body, a first end configured in a hook, a second end bent substantially ninety degrees to said main body, said second end having an aperture therethru having the same diameter as said aperture in said first leg of said spring housing;

an elongate compression spring entrapped between said first leg of said spring housing and said second end of said spring follower;

a shoulder bolt, said shoulder bolt entering said aperture in said first leg of said spring housing, sliding thru the inside of said compression spring, passing thru said aperture in said second end of said spring follower where the shoulder portion is stopped by the smaller diameter of said aperture in said second leg of said spring housing but the threads pass thru and said bolt is locked by a nut;

a cover having a bottom, two sides and two open centered ends fitting in frictional engagement over the outside of said legs of said spring housing;

a buoyant collar assembly attached in biased suspension between two said tension assemblies;

a plurality of fairlead assemblies attached by suitable means to said boat hull and supporting said buoyant collar assembly; and a pluality of semi-rigid bumpers, one said bumper enclosing each said tension assembly and each said fairlead assembly whereby said bumpers serve as fenders for said boat.

2. A nautical safety device carried on the top outside of a boat hull comprises:

a plurality of tension assemblies attached by suitable means to said boat hull;

a buoyant collar assembly attached in biased suspension between two said tension assemblies;

a plurality of fairlead assemblies attached by suitable means to said boat hull and supporting said buoyant collar assembly;

wherein said fairlead assemblies each comprise:

a rectangular block having a semi-circular recess extending inwardly from one side;

a flat closure plate;

a flat backup plate;

said rectangular block, said flat closure plate, said boat hull and said flat backup plate having a matching plurality of apertures therethru for attaching said fairlead assembly to said boat hull whereby a flexible cable of said buoyant collar assembly may be slidably engaged in said recess of said block and said fairlead assembly will assist in holding said buoyant collar assembly in biased suspension at said top outside of said boat hull; and a plurality of semi-rigid bumpers, one said bumper enclosing each of said tension assembly and each said fairlead assembly whereby said bumpers serve as fenders for said boat.

* * * * *